United States Patent [19]

Nakazawa et al.

[11] 4,088,513

[45] May 9, 1978

[54] METHOD FOR HEATING A SILICON-CONTAINING STEEL SLAB IN A WALKING-BEAM TYPE HEATING FURNACE

[75] Inventors: Kichi Nakazawa; Masafumi Okamoto; Kiyoshi Tanaka; Tadashi Sakazaki, all of Himeji, Japan

[73] Assignee: Nippon Steel Corporation, Tokyo, Japan

[21] Appl. No.: 686,664

[22] Filed: May 14, 1976

[30] Foreign Application Priority Data

Apr. 3, 1976 Japan ..... 51-36710

[51] Int. Cl.[2] ..... H01F 1/04

[52] U.S. Cl. ..... 148/112; 148/13; 148/155

[58] Field of Search ..... 148/111, 112, 121, 13, 148/14, 155, 156; 266/252

[56] References Cited

U.S. PATENT DOCUMENTS

| | | | |
|---|---|---|---|
| 3,567,195 | 3/1971 | Kakuta et al. | 266/252 |
| 3,764,406 | 10/1973 | Littmann | 148/111 |

*Primary Examiner*—Walter R. Satterfield

[57] ABSTRACT

A method for treating a steel slab containing 2.5 to 4% Si to a temperature not lower than 1260° C in a continuous heating furnace of the walking-beam type, comprising; charging the slabs into the continuous heating furnace through its charge inlet, transferring the slabs by means of walking-beams in the furnace with the rear end of a preceding slab substantially contacting a front end of a subsequent slab under the condition that the contact time of the slab with fixed beams is not more than three times longer than the contact time of the slab with the transfer beams, and separating the adjacent slabs with a space sufficient to permit remelting of solidified slag adhered between the adjacent slabs approaching the extraction outlet of the furnace.

3 Claims, 8 Drawing Figures

METHOD FOR HEATING A SILICON-CONTAINING STEEL SLAB IN A WALKING-BEAM TYPE HEATING FURNACE

BACKGROUND OF THE INVENTION

1. Field of the Invention

The present invention relates to a method for heating effectively a steel slab for a grain-oriented electrical steel sheet in a walking-beam type heating furnace, and particularly a method for operating such a heating furnace to achieve effective heating of the slab.

Grain-oriented electrical steel sheet, for example, a cube-on-edge oriented electrical steel sheet, has a texture in which the (110) plane of the grains is oriented pallarel to the rolling plane and the [001] plane is oriented parallel to the rolling direction. Grain-oriented electrical steel sheet having such a crystallographic orientation of (100)[001] is characterized by excellent magnetic properties in the rolling direction, and has been widely used in various industries as iron cores for transformers, a large rotator, etc. to take advantage of this characteristic.

2. Description of Prior Art

In the production method for a grain-oriented electrical steel sheet, the following process, for example, has been commonly practised as a conventional process.

A hot rolled steel sheet normally about 2.5 mm thick is prepared by melting a suitable steel composition, casting a refined steel ingot or slab from the molten steel, and hot rolling the ingot or slab with necessary heat treatments, and the hot rolled steel sheet is then subjected to acid pickling, one step cold rolling, or two-or more-step cold rolling including intermediate annealing to obtain a cold rolled steel sheet having the final thickness, sheet is then subjected to decarburization and final high-temperature annealing.

In the final high-temperature annealing of the above conventional process, the properties required for the grain-oriented electrical steel sheet are obtained by development of secondary recrystallization grains having (110)[001] orientation. In this case, precipitates produced by trace elements contained in the steel play an important role. As the precipitates, MnS, AlN, MnSe, etc. have been widely known, and what is most important is to form precipitates as fine as possible in the hot rolled steel sheet. For this purpose, it has been considered to be essential that the steel slab prior to the hot rolling be soaked to a temperature high enough to dissolve impurities during the slab heating step, and that appropriate cooling conditions be used so as to assure reprecipitation of the impurities as fine precipitates. Regarding the slab heating for dissolving the impurities as a pretreatment for formation of fine precipitates, a slab heating temperature ranging from 1260° to 1400° C has been commonly used as taught U.S. Pat. No. 2,599,340.

However, when a higher temperature within the above slab heating temperature range is applied, abnormal growth of the slab grains is caused, and this abnormal grain growth causes deterioration of the magnetic properties.

Therefore, it is almost impossible to produce a grain-oriented electrical steel sheet having a high degree of stabilized magnetic properties, unless heating conditions are used which avoid the above drawback. Thus, in the treating of a slab for a grain-oriented electrical steel sheet, it is important to heat the slab uniformly so as to assure that the lowest temperature portion in the slab is not lower than the dissolution temperature of the impurities and the highest temperature portion in the slab is lower than the temperature which causes the abnormal grain growth.

Conventionally, as the slab heating furnace for the above purpose, a pusher-type heating furnace as shown in FIG. 1 has been widely used, although a walking-beam type heating furnace as shown in FIG. 2 has also come to be used.

In the operation of the pusher-type heating furnace, the slab 1 is pushed by a pusher 3 and slid onto a water-cooled skid 2. During the sliding onto the skid, skid marks are formed on the under surface of the slab. Therefore, where uniform heat soaking is required as in the heating of a slab for a grain-oriented electrical steel sheet, such operating techniques are used as making the traveling time of the slab along the floor 4 of the soaking furnace longer, or the position and arrangement of the skid rails are changed so as to make the skid rails contact with the slab under surface only at one position, as disclosed in Japanese Patent Publication Sho 38–15425, Japanese Utility Model Publications Sho 42–18766 and Sho 41–19210.

Thus, the pusher-type heating furnace has the defect that considerable surface damage is caused to the slab under surface during the sliding of the slab on the skid rails or on the bottom brick work of the soaking furnace. This defect is serious in the heating of a slab for a grain-oriented electrical steel sheet, where the slab is heated at a high temperature as compared with an ordinary steel slab in order to obtain excellent magnetic properties, and the hot strength of the slab is considerably lower than that of an ordinary steel slab due to the high silicon content of 2.5 to 4%. As a result, the commercial value of the product will be completely lost due to the damage to the under surface. Further in case of a slab for grain-oriented silicon steel sheet, as well as an ordinary steel slab, a molten scale (commonly called "slag") mainly composed of iron oxides (FeO, $Fe_2O_3$, $SiO_2$) is formed by the reaction between the furnace atmosphere and the slab surface, and this scale accumulates irregularly on the skid rails or on the bottom floor of the soaking pit so that a subsequent slab may be caused to run over a preceding slab in what is commonly called a slab overlapping phenomenon which hinders the furnace operation.

As one solution to the problems of surface damage to the under surface of the slab and the irregular scale accumulation in the pusher-type heating furnace, it has been proposed that the slab heating be concentrated only on the upper surface and the temperature of the under (lower) surface be kept relatively low until the slab enters the soaking zone so as to reduce the surface damage.

However, this solution is not very effective to prevent the back surface damage caused by the sliding on the soaking zone floor, and has a drawback that the temperature of the slab upper surface very often becomes extremely high during the heating because the surface temperature of the lower or under surface is raised by the heat retained by the slab upper surface after the slab enters the soaking zone, resulting often in abnormal grain growth and hence abnormal magnetic properties.

As described above, the method of heating a slab for a grain-oriented electrical steel sheet in a conventional pusher-type heating furnace does not achieve completely satisfactory results with respect to both the surface defects and the magnetic properties, and a suitable solution of these problems has long been sought.

Meanwhile the walking-beam type heating furnace which has just come to be used for the slab heating has a remarkable efficacy for preventing under surface damage which is unavoidable in the pusher-type heating furnace, because a transfer beam 5 and a fixed beam 6 are provided, and the slab 1 is lifted up and transferred a certain constant distance by the transfer beam as shown in FIG. 2 and FIG. 3. But the walking-beam type furnace has not yet been adopted for heating a slab for grain-oriented electrical steel sheet for the following reasons.

(1) Because the transfer of the slab in the walking-beam type treating furnace is performed by the combination of the driving of the transfer beam and the fixed beam, the slab is curved or bent by the shock given to the slab when the slab is transferred from the transfer beam onto the fixed beam, or when it is taken up onto the transfer beam from the fixed beam, resulting in difficulties in the slab transfer within the furnace or the slab transfer by means of a table roller.

(2) The scale accumulation on the beams caused by the high temperature heating of the slab causes damage to the slab under surface and the slab is difficult to extract due to its having been turned at an angle to the transfer direction because of scale accumulation, and when the distance between beams is made small in order to reduce the problem (1) the apparent diameter of the beams is increased by the scale accumulation and thus the beams interfere with each other, hindering smooth driving of the beams.

SUMMARY OF THE INVENTION

The present invention is based on the discovery that the walking-beam type heating furnace is very effective to prevent under surface abrasion damage to a slab for grain-oriented electrical steel sheets which is subjected to a very high temperature heating, and has been completed after various extensive studies and experiments on the application of the walking-beam type heating furnace to the heating of slabs for grain-oriented electrical steel sheets.

The present invention provides a method for heating a steel slab containing 2.5 to 4% Si suitable for production of grain-oriented electrical steel sheet to a temperature not lower than 1260° C in a continuous heating furnace of the walking-beam type, and the main features of the present invention are;

(a) the slabs are charged successively into the continuous heating furnace of the walking-beam type through its charge inlet, and are moved by means of walking-beams with the front end of a subsequent slab substantially contacting with a rear end of a preceding slab, (b) the slab movement by means of the walking beams is carried out under the condition that the contact time of the slab with fixed beam is not more than three times longer than the contact time of the slab with a transfer beam, and (c) near the extraction outlet of the continuous heating furnace, adjacent slabs are separated sufficiently to provide a space large enough for remelting solidified slag adhered to the slabs between the adjacent slabs.

Further features of the present invention are;

(d) the atmosphere around the under surface of the slab in the furnace is maintained at 1300° C or higher, (e) the space between the adjacent slabs near the extraction outlet is not less than 1/5 of the slab thickness, (f) at the time of extraction of the slab from the continuous heating furnace, the extractor arm is inserted into the furnace at least to the second slab from the front slab in the furnace to hold the second slab, and then the arm holding the second slab is retracted to deposit the second slab on the walking beam with an enough space between the second slab and the front and third slabs in the furnace, and the front slab is engaged and extracted from the furnace by the arm.

DETAILED DESCRIPTION OF THE INVENTION:

In the present invention, the Si content of the slab has been defined as being from 2.5 to 4% for the reason that amounts of Si below 2.5% do not produce a grain-oriented electrical steel sheet having excellent magnetic properties, particularly iron loss, while amounts of Si above 4% cause cold embrittlement which in turn causes difficulties in constant production on a commercial scale.

Regarding the other elements, various elements should be present in amounts sufficient to form precipitates from which grains having (110)[001] orientation are selectively made to grow by secondary recrystallization. For example, when MnS is used as the required precipitate forming compound, a slab containing 0.03 to 0.15% Mn and 0.015 to 0.030% S with the balance being iron and unavoidable impurities is used, and when AlN is utilized as the required precipitate forming compound a slab containing 0.01 to 0.06% Al and 0.0004 to 0.01% N with the balance being iron and unavoidable impurities is used, and further when Sb + Se is used as the precipitate forming compound, a slab containing 0.02 to 0.2% Sb and 0.01 to 0.1% Se with the balance being iron and unavoidable impurities is used.

The slab used in the present invention may be any slab such as obtained by breaking down the ingot produced by an ordinary ingot making method, or obtained directly by continuous casting, or obtained by rolling the continuously cast slab.

Figure 1:
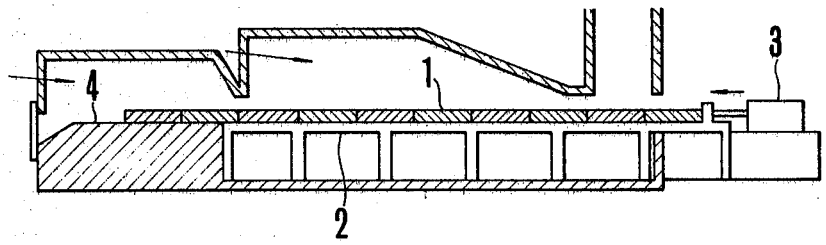
FIG. 1 is a schematic section of a pusher-type heating furnace.
Figure 2:
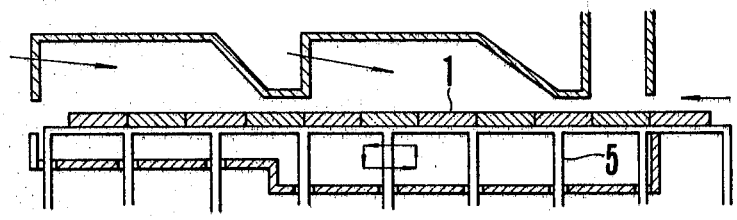
FIGS. 2 and 3 are longitudinal and schematic sections, respectively, of a walking-beam type heating furnace.
Figure 3:
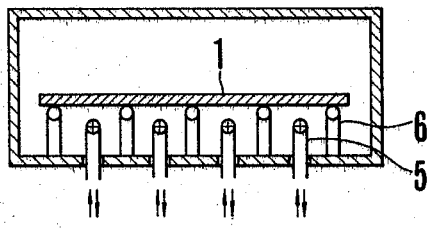

For heating the slab of the above composition in a walking-beam type furnace, the present inventors first made studies relative to the bending of the slab. As shown in FIG. 2 and FIG. 3, in the walking-beam type furnace, the slab and the beam are subjected to a considerable shock when the stationary slab is taken up by the transfer beam, or when the slab is deposited on the fixed beams, during the downward movement of the transfer beam. Yet the walking-beam type furnace is not provided with a flat soaking floor. Meanwhile the slab for grain-oriented electrical steel sheets is heated at high temperatures, and contains a high Si content which greatly reduces the hot strength of the slab so that considerable bending of the slab is caused and the slab transfer by the transfer beam and the slab transfer on the roller table very often encounter considerable difficulties.

Further, the slab for grain-oriented electrical steel sheets generally has a thickness from 120 mm to 250 mm, while it is desirable to maintain a distance of from about 700 to 1000 mm between the centers of the fixed beams and the elements of the transfer beam so as to reduce the bending of the slab to an amount within a range which causes no practical problem even when the slab is heated to its maximum heating temperature of 1380° C. Thus the problem of bending of the slab has been solved, but another problem has arisen and the furnace operation had to stop in some cases after several heating tests.

Figure 4:
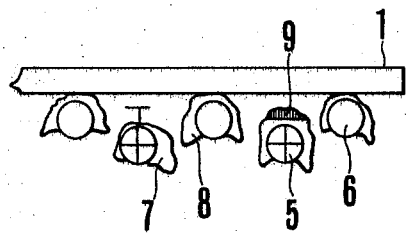
FIG. 4 is an enlarged schematic view showing how the slag accumulates on the beams.

FIG. 4 shows the state of the fixed beams and the elements of the transfer beam where the slab transfer by the transfer beam is not performed smoothly and the furnace operation was forced to stop after 1500 tons of slabs for grain-oriented electrical steel sheets had been heated within a temperature range from 1260° to 1350° C.

During the heating of the slab for grain-oriented electrical steel sheet, when the slab surface temperature exceeds 1200° C, molten scale or slag is formed on the slab surface, and the molten scale or slag formed on the under side of the slab immediately flows down onto the beams or the furnace floor, while the molten scale or slag formed on the upper side of the slab flows down over both ends of the slab and through the spaces between the adjacent slabs onto the beams or the furnace floor. As for the treatment of the molten scale or slag flowing onto the furnace floor, Japanese Utility Model Publications Sho 47-2789 and Sho 49-15, for example, propose a technique for preventing the scale or slag from flowing into the hole of the transfer beam post, and as for the treatment of the molten scale or slag on the furnace floor, Japanese Patent Publication Sho 49-3884, for example, proposes a technique for removing the scale or slag from the furnace and crushing it by a water jet. However, these prior art disclosures can not and do not intend to overcome the problem that the molten scale or slag flowing down onto the beams adheres to the outer surface of the beams so as to increase the beam diameter in a direction transversely of the furnace (see 7, 8 in FIG. 4), and the slag adhering to the adjacent slabs partially contact each other, so that the movement of the transfer beam is hindered and thus the furnace operation is stopped. Moreover, the scale or slag does not accumulate uniformly on the beams, but often forms an abnormal accumulation 9 locally, and if such abnormal accumulation takes place on the transfer beam 5, the slab under surface is damaged by the partial contact with the abnormal accumulation 9 during the slab transfer by the transfer beam, and the slab extraction from the furnace is hindered by the displacement of the slab during transfer caused by collision of the slab with the abnormal accumulation.

As described above, when the beam spacing is reduced for the purpose of preventing the slab bending during the slab heating in the walking-team type heating furnace, another problem as above occurs.

As for the problem of molten scale or slag formed during the high temperature of the slab for grain-oriented electrical steel sheet, Japanese Patent Publication Sho 47-25250, and Patent Publication Sho 46-27664 disclose adjustment of the slab composition for the purpose of reducing the slag formation by lowering the slab heating temperature. However, it is necessary to control the slab composition very closely in order to lower the slab heating temperature, and unsuccessful control of the slab composition will inevitably lead to deviation of the magnetic properties. And even when the slab composition adjustment is carried out to prevent the flowing of molten scale or slag, a small amount of molten scale of slag accumulates on the beam when the slab surface temperature exceeds about 1260° C. Thus, such slag composition adjustment does not overcome all of the problems of the abnormal accumulation, such as hinderance to the movement of the transfer beam due to the increase of the diameter of the elements of the beam or the fixed beams.

The present invention has solved all of the above problems by a method of heating a slab to a high temperature contrary to the conventional method and which reduces the slag formation by lowering the slab heating temperature.

When a steel slab is heated in a walking-beam type furnace, the slabs are successively charged into the furnace through the charge inlet, and the slabs deposited on the beams in the furnace are transferred toward the outlet of the furnace by the co-working of the fixed beams and the walking-beam. The conventional method does not take into consideration the space between a preceding slab and a subsequent slab.

According to the present invention, the space between the preceding slab and the subsequent slab during their movement in the furnace is substantially eliminated so as to substantially reduce or prevent the flowing of molten scale or slag down the end sides of the slab and hence to reduce or prevent the slag accumulation or adhesion on the beams.

The elimination of the space between the adjacent slabs in the present invention means that the adjacent slabs are initially brought into contact with each other, or that the adjacent slabs are initially separated by a small space and are brought into contact by the thermal expansion of the slabs during their heating. The contact of the adjacent slabs as described above will not only reduce or prevent the flow-down of the molten scale or slag, but will substantially reduce the amount of surface on the both ends of the slab which is heated, thus preventing an abnormally high heating of the ends of the slab. In this way abnormal grain growth in these portions can be prevented, as well as intergranular oxidation, material deterioration and edge cracks during the rolling can be efficiently prevented.

However, the end face of the slab has sharp convexities and concavities, and when the ends of adjacent slabs are brought into contact, a small space of 10 mm or less may remain therebetween. As a result, molten slag, although in a small amount, flows down through the space, a part of which accumulates on the beams and another part solidifies and adheres in the small space.

The slag accumulation on the beams will be explained in detail hereinbelow.

Hardly any of the molten slag adhering to the upper surface of the beam flows down therearound due to the horizontal flatness of the surface and solidifies thereon due to the cooling effect of the beam.

According to the inventors' observations, the slag accumulation on the beams is caused predominantly when the beams and the slab are out of contact, and the abnormal local slag accumulation is caused by the slag flowing down onto the beams through the space between a preceding slab and a subsequent slab, and this abnormal local slag accumulation is mainly on the transfer beam.

As is well known, the slab heating in a walking-beam type heating furnace is carried out with the slab stationary on the fixed beams, and only when the slab is transferred is the transfer beam are driven. On the basis of this principle, the time during which the transfer beam is in contact with the slab is very short as compared with that during which the fixed beams contact the slab. In other words, the time during which the transfer beam is out of contact with the slab is very long. According to the results of investigations conducted by the present inventors, the ratio of the time the fixed beams contact the slab to the time the transfer beam contacts the slab is about 8 – 6 : 1.

It has been found by the present inventors that the slag accumulation on the beams can be reduced by shortening the time the beams are out of contact with the slab, and this leads to reduction of the normal local slag accumulation. On the basis of the above facts, the present inventors have succeeded in solving the problem of the abnormal local slag accumulation on the transfer beam by modifying the conventional driving system for the transfer beam so as to use the transfer beam for idling the slab in addition to its inherent function of slab transfer, thus increasing the contact time of the transfer beam with the slab, or decreasing their non-contact time with the slab. For this purpose it is necessary to maintain the ratio of the time of contact of the fixed beams with the slab to the time of contact of the transfer beam with the slab at 3 : 1 or lower, and beyond this ratio, it is difficult to prevent the abnormal local slag accumulation on the transfer beam.

As a result of the elimination of the abnormal slag accumulation on the beams by reducing the time the transfer beam is out of contact with the slab during the high temperature heating of the slab for grain-oriented electrical steel sheets in a walking-beam type heating furnace, the surface damage to the under surface of the slab is greatly reduced and the difficulties in the extraction of the slab from the furnace due to the displacement of the slab during transfer caused by collision with the abnormal slag accumulations are efficiently overcome.

Hereinbelow, a description will be given of the solidification and adhesion of the molten scale or slag in the small spaces between the adjacent slabs.

The molten slag flowing into the small space is sufficiently heated due to the shadow effect and solidifies and adheres to the end faces of the slabs. When a slab with slag adhered to its end faces is extracted from the furnace and hot rolled directly, the oxide adhesion is entrained in the steel during the rolling and causes scabs or holes in a region extending about 100 mm from the edge of the rolled product, thus causing a deterioration in the quality of the material and lowering the yield.

According to the present invention, the slabs successively transferred from the inlet through the furnace with their ends contacting each other are separated so as to provide a space between the adjacent slabs approaching the outlet sufficient to eliminate the shadow effect and to remelt the solidified adhered slag (mainly composed of Fe) for its removal therefrom. In this case, the separation of the front slab from the subsequent slab by extracting the front slab from the furnace does not give the front slab enough travelling time in the furnace so that the desired object of the present invention can not be attained. Therefore, in order to attain the object, it is necessary to provide the space for a slab preceding the front slab by at least one slab. However, if the space is provided too early the effect attained by the transfer of the slabs while they are in contact is nullified. Therefore, in practice, it is desirable to provide the space for a slab preceding the front slab by from one to three slabs depending on the size of the space and the slab travelling time in the furnace after the slabs are separated.

As for the space to be provided between the adjacent slabs toward the outlet of the heating furnace, it is necessary to provide a space large enough to remelt the solidified slag between the adjacent slabs, and in practice a space not less than 1/5 of the slab thickness is desirable, although it varies depending on the furnace atmosphere the temperature and the flame condition.

As for the method for providing the space between the adjacent slabs in the heating furnace and for maintaining the space until the slabs are extracted from the furnace, various method have been considered. For example, an auxiliary walking-beam can be provided near the extraction outlet of a walking-beam type furnace, whereby the space is provided between the adjacent slabs, and thus the separated slabs are transferred by means of the walking beams and the fixed beams. The following method is most desirable because it entails no increased cost and the operation is simple.

Figure 5:
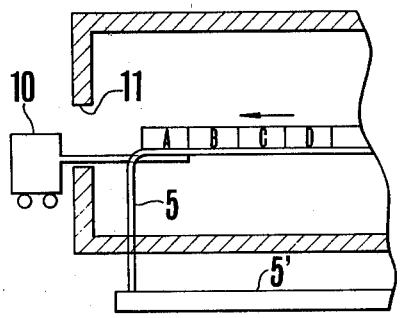
FIG. 5 is a partial schematic longitudinal section of a walking-beam furnace showing the extraction of slabs.

Referring to FIG. 5, the outlet end of the furnace has a transfer beam 5, a driving device 5' for the transfer beam 5, an extractor 10, and an extraction outlet 11. The fixed beams are not shown in FIG. 5, because they are behind the transfer beam 5. The slabs A, B, C, D are charged through the charge inlet successively with their rear ends being contacted by the front ends of the subsequent slabs, and are transferred by the rectangular movement of the transfer beam 5. For the extraction of the slab A by means of the extractor 10, the arm of the extractor is extended through the outlet 11 under the slab A, and the slab A is transferred onto the arm and extracted from the furnace by the arm.

Figure 6:
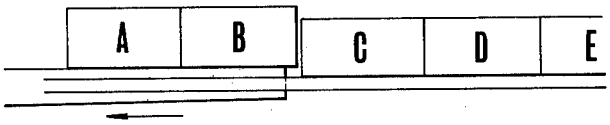
FIGS. 6 to 8 are schematic views showing how the space is provided between the adjacent slabs.
Figure 7:
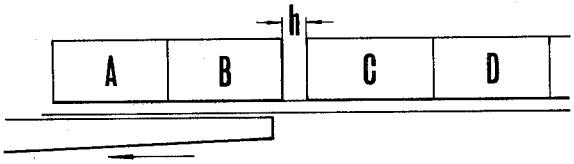
Figure 8:
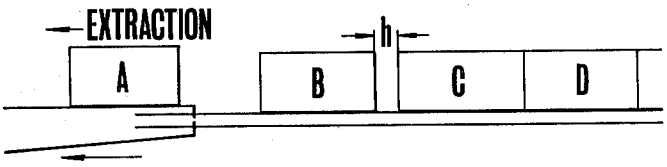

According to the present invention, when it is time to extract the slab A, first the arm of the extractor 10 is moved under the slab B, and the slabs A and B are transferred onto the arm as shown in FIG. 6, and then as shown in FIG. 7, the extractor is withdrawn until the predetermined space *h* is provided between the slab B and the slab C, and then the slabs A and B are lowered onto the fixed beams. Then, as shown in FIG. 8, the arm of the extractor is lowered and retracted to a position below the slab A, and the slab A is then transferred onto the arm and extracted from the furnace. In this way, the required space between the slab B and the slab C is maintained until the slab B is extracted.

Next when it is time to extract the front slab B, the required space is provided between the slab C and the slab D by the same operation as above.

As described hereinbefore, the slab is heated to a temperature not lower than 1260° C in the present invention, and particularly when the furnace atmosphere temperature under the lower side of the slab is maintained at 1300° C or higher, the flowability of the slag increases, thus reducing the amount of slag adhering to the beam, and faciliating the exhaust of the slab through the slag exhaust opening in the furnace floor.

PREFERRED EMBODIMENT:

The present invention will be more clearly understood from the following example.

A steel slab for a grain-oriented electrical steel sheet, containing 3.00 to 3.20% Si, 0.05 to 0.07% Mn and 0.15 to 0.25% S, and having a thickness from 160 to 220 mm is heated in a walking-beam type heating furnace under the heating conditions set forth below:

Atmosphere temperature for the under side of the slab: 1320° – 1340° C

Atmosphere temperature for the upper side of the slab: 1340° – 1380° C

Heating period in the furnace: 3 hours.

The slabs are charged one after another with their rear ends contacted by the front ends of the subsequent slabs, and transferred one by one every 8 minutes. The transfer of one slab requires two cycles of rectangular movement of the transfer beam, and one cycle is done in one minute (30 seconds on the transfer beam) under the above transfer condition, and one operation of raising the slab by the vertical movement of the transfer beams for 2 minutes is added every two cycles. As the result, the slab is on the fixed beams for 5 minutes and on the transfer beam for 3 minutes. The slabs are extracted every 4 to 8 minutes, and a space of about 200 mm is provided between the slab B and the slab C.

With the operation of the walking-beam type heating furnace under the above conditions, it is possible to hot roll 6000 tons of slabs per furnace before it is necessary to stop operation of the heating furnace due to the slag accumulation on the beams, and the slabs extracted from the furnace have no adhesions on the end portions which cause surface defects during the rolling.

On the other hand, when the heating operation is carried out under the following conditions, it is necessary to stop the furnace operation after 1500 tons of slabs per furnace are rolled.

Atmosphere temperature for the upper side of the slab: 1300° to 1340° C

Atmosphere temperature for the under side of the slab: 1260° to 1290° C

Ratio of the time of contact of the slab with the fixed beams to that with the transfer beam: 4 : 1.

Meanwhile when the heating operation is carried out with a space of 0 and 30 mm between the slab B and the slab C, large adhesions occur on the end faces which causes a considerable number of scabs and holes in the edge portions during the rolling.

The slab heated according to the present invention is hot rolled and subjected to two-step cold rolling including intermediate annealing at 870° C for 2 minutes to obtain a final thickness of 0.30 mm .Then the cold rolled steel strip is subjected to decarburization annealing at 850° C for 3 minutes, and high-temperature annealing in pure hydrogen at 1200° C for 24 hours to obtain a grain-oriented electrical steel sheet.

The magnetic properties at the both end portions of the 5 ton steel coil thus obtained, and occurrence of surface defects per coil are shown in Table 1, in comparison with those obtained by a similar material heated by a conventional pusher-type heating furnace.

Table 1

| | Magnetic Properties | | | | | Number of Defects on Slab |
|---|---|---|---|---|---|---|
| | Iron Losses W 17/50(W/kg) | | Permeability $B_8$ (wb/m²) | | Z9 | Back Surface counted per |
| | $\bar{x}$ | $\sigma$ | $\bar{x}$ | $\sigma$ | % | Coil Product |
| Present Invention | 1.247 | 0.032 | 1.838 | 0.0011 | 86.4 | 1.58 |
| Conventional Art | 1.288 | 0.041 | 1.822 | 0.0015 | 65.0 | 11.16 |

What is claimed is:

1. In a method for heating a grain-oriented electrical steel slab containing 2.5 to 4% Si to a temperature not lower than 1260° C in a continuous walking-beam type heating furnace, the improvement comprising:

charging the slabs one after the other into the said furnace through the charge inlet thereof and moving the successive charged slabs into contact with the last of the slabs already in the furnace for causing the rear end of a preceding slab to substantially contact the front end of a subsequent slab during the heating in the furnace;

transferring the slabs through the furnace by means of the walking-beam means of the furnace having fixed beams and a walking-beam means while operating the walking-beam means for limiting the contact time of the slabs with the fixed beams to not more than three times the contact time of the slabs with the walking-beam means; and separating the adjacent slabs approaching the extraction outlet of the furnace a distance not less than one-fifth the slab thickness for remelting solidified slag adhering to the slabs on opposite sides of the spaces between the thus separated slabs.

2. The improvement according to claim 1 further comprising maintaining the atmosphere around the lower side of the slab in the furnace at a temperature of at least 1300° C.

3. The improvement according to claim 1 wherein the step of separating the adjacent slabs comprises inserting an extractor arm into the furnace to at least beneath the second from the end slab in the furnace, lifting the end slab and the second from the end slab and moving them away from the third from the end slab a distance not more than one-fifth the thickness of the slabs, moving the extractor arm beneath the last slab and removing the last slab by means of the extractor arm while leaving the next to last slab in the furnace, and finally removing the next to last slab from the furnace with the extractor arm.

* * * * *